United States Patent [19]

Caverly

[11] 4,237,702

[45] Dec. 9, 1980

[54] NECKLACE

[76] Inventor: Richard Caverly, 32716 Franklin Rd., Franklin, Mich. 48025

[21] Appl. No.: 42,059

[22] Filed: May 24, 1979

[51] Int. Cl.[3] ..... A44C 5/00; A44C 25/00

[52] U.S. Cl. ..... 63/2; 24/49 S; 24/81 AA; 63/31

[58] Field of Search ..... 63/1, 2, 3, 5, 11, 31; 24/49 S, 81 A, 81 AA, 81 AW

[56] References Cited

U.S. PATENT DOCUMENTS

| | | | |
|---|---|---|---|
| 293,418 | 2/1884 | Church | 63/3 X |
| 331,033 | 11/1885 | Chadwick | 63/5 R |
| 1,403,600 | 1/1922 | Grand et al. | 63/11 |
| 1,694,703 | 11/1928 | Döppenschmitt | 63/11 |
| 2,637,884 | 5/1949 | Morehouse | 24/49 S |
| 3,273,766 | 9/1966 | Cosentino | 63/31 UX |

FOREIGN PATENT DOCUMENTS

| | | | |
|---|---|---|---|
| 808098 | 11/1936 | France | 63/11 |
| 2376638 | 9/1978 | France | 63/31 |
| 319690 | 4/1957 | Switzerland | 63/1 R |
| 165289 | 6/1921 | United Kingdom | 63/31 |

*Primary Examiner*—F. Barry Shay

*Attorney, Agent, or Firm*—Cullen, Sloman, Cantor, Grauer, Scott & Rutherford

[57] ABSTRACT

A necklace comprises an elongated strand consisting of a series of interconnected links of a polygonal cross section with the depending free ends of the strand spaced apart. A series of spaced housings are non-rotatably mounted upon the strand for selective longitudinal adjustment. Opposed walls of each housing having an aperture therethrough of a corresponding polygonal shape to cooperatively engage the strand. Each housing has an end wall and an open end including an ornament facing outwardly of the strand. A resilient spacer is interposed in compression between the end wall and strand for yieldably retaining the housing against longitudinal movement relative to the strand. A pair of housings on the strand are laterally spaced apart and interconnected.

13 Claims, 7 Drawing Figures

NECKLACE

BACKGROUND OF THE INVENTION

In the jewelry art relating to necklaces various types of connectors have been adjustably interposed between the free ends of the strand in the front of the wearer for a desired ornamental effect. Shoelace neckties of this same type have been heretofore employed with a slidable clip interposed between the free ends thereof and adjustably mounted thereon for regulating the shape of the necklace or tie.

SUMMARY OF THE INVENTION

It is the object of the present invention to provide a necklace comprising an elongated strand consisting of a series of links interconnected end to end and of polygonal cross section or round with the free ends of the strand parallel and spaced apart. A series of spaced slide housings are non-rotatably mounted upon the strand for selective longitudinal adjustment thereon. Opposed walls of each housing have an aperture therethrough of a corresponding polygonal shape or round, of a size to cooperatively engage the strand with the housings being non-rotably mounted thereon. Each housing has an end wall and an open end with the latter facing outwardly at right angles to the strand. Outwardly facing ornamental means such as a semi-precious gem or precious gem or stone or other object is nested and retained within the housing open end. A resilient friction spacer means is nested within the housing in compression between the end wall and the strand for adjustably retaining the housing against longitudinal movement relative to the strand. A stop means are provided upon the ends of the strand to prevent accidental separation of the housings therefrom. A pair of housings on the strand are laterally spaced apart and fixedly interconnected for maintaining a predetermined spacing between portions of the strand.

The links are preferably of a polygonal cross section and with the apertures through the housing of the same shape and of a size so as to cooperatively receive the housings with the housing retained against relative rotary movement with respect to the strand and thus at all times facing outwardly with the gem therein or other ornament facing outwardly. The housings can be cylindrical or square or any other desired shape. The housings may be arranged in laterally opposed pairs upon the strand with at least one pair of housings interconnected for holding the strands ends together. The housings may be arranged in groups or spaced apart, or alternated.

The friction means which is interposed as a spacer between the housing end wall and the strand may be of silicone rubber, rubber, neoprene or cork, and of a shape corresponding to and snugly nested within the housing. A second resilient spacer is interposed in compression between the strand and the undersurface of the ornamental means such as the undersurface of a diamond or other gem and is of a shape corresponding to and snugly nests within the housing for excluding dust and dirt from the undersurface of the ornamental gem.

It is an object of the present invention to provide an improved necklace wherein upon a strand of gold or other material consisting of a series of links there are selectively mounted and adjustably applied to said strand a series of outwardly facing housings which are non-rotatably mounted thereon and wherein each of the housings mounts a gem or other ornament for improving the appearance of the necklace. A resilient spacer means is interposed in compression between the housing end wall and the strand for frictionally retaining the housing against longitudinal movement relative to the strand.

It is another object to provide a necklace or a bracelet wherein upon a unit strand of gold or other flexible material there are selectively and adjustably mounted a series of outwardly facing housings which are non-rotatably mounted thereon and wherein each of the housings mounts a gem.

These and other objects will be seen from the following Specification and Claims in conjunction with the appended drawing.

THE DRAWINGS

It will be understood that the above drawing illustrates a preferred embodiment of the invention, and that other embodiments are contemplated within the scope of the Claims hereafter set forth.

DETAILED DESCRIPTION OF AN EMBODIMENT OF THE INVENTION

Figure 1:
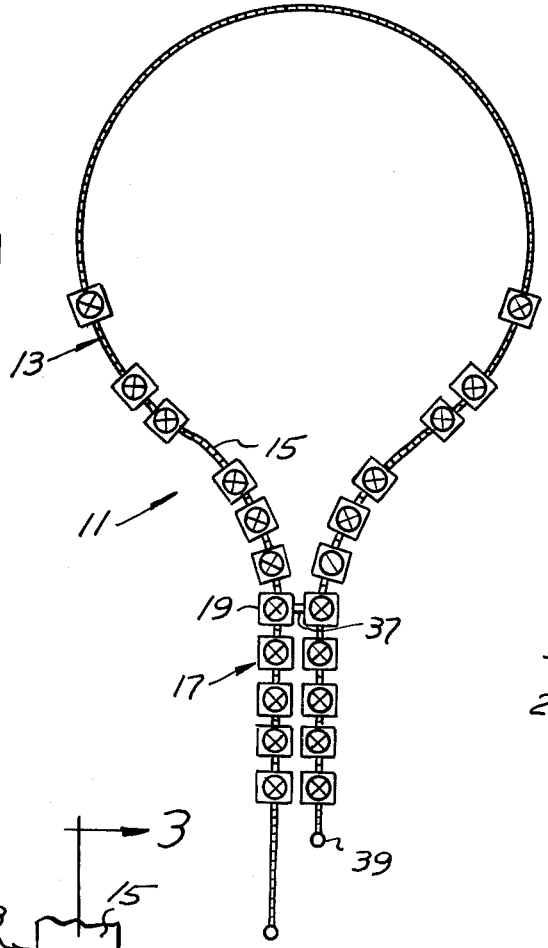
FIG. 1 is a front elevational view of the present necklace
Figure 4:
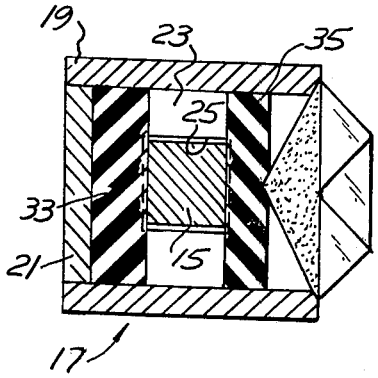
FIG. 4 is a plan section taken in the direction of arrows 4—4 of FIG. 3.
Figure 2:
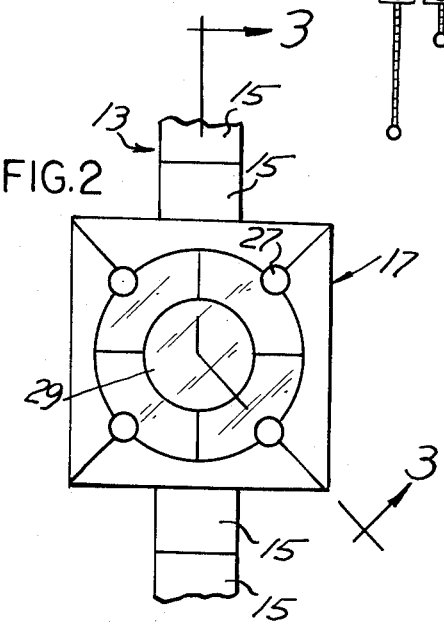
FIG. 2 is a fragmentary front view of a portion fo the necklace to which an ornament mounting housing has been applied.

The present necklace generally indicated at 11, FIG. 1, includes a strand 13 consisting of a series of links 15, of gold or other metal, interconnected end to end and in the illustrative embodiment square in cross section as shown in FIG. 4.

A series of gem mounts 17 are adjustably applied to portions of the strand normally adjacent the free ends thereof.

Each mount includes a hollow slide housing 19 round or square or other desired cross sectional shape having at one end, end wall 21 with the other end of the housing open and facing outwardly on an axis normally at right angles to the longitudinal axis of the strand.

Each housing includes an interior chamber 23 and within opposed walls thereof there is formed a transverse aperture 25 preferably of polygonal shape of a size so as to cooperatively receive the respective links 15 and adapted for slidable non-rotative adjustment therealong.

The aperture 25 although shown square, could be rectangular or any other polygonal shape so as to correspond to the cross sectional shape of the strand. Under some conditions the housing wall opposed apertures may be round to receive a strand such as shown at 41 in FIG. 5.

Conventional radially extending prongs 27 are spaced apart around the open end of the housing and adapted to retainingly engage an ornamental means which may be a gem such as a diamond or a ruby or an emerald or non-precious gem generally indicated at 29. The gem retainer may be annular.

In the illustrative embodiment, and as is the case with many gems, the undersurface of the stone or gem is suitably coated as at 31.

Disposed within the housing chamber 23 is a resilient friction means or spacer 33 which is interposed in compression between end wall 21 and the corresponding adjacent side of the strand 13. The spacer is preferably of silicone rubber, but can be made of any other suitable resilient material such as conventional rubber or neoprene or cork.

The spacer is normally of a shape corresponding to the internal cross sectional shape of the housing and is snugly interposed therein and is adapted to frictionally engage the strand as shown in FIG. 4.

The objective and function of the spacer is to retain the housing and the associated ornament in any preselected position of longitudinal adjustment upon the strand. Thus the housings are individually adjustable along the strand and will normally stay in the position set. Due to the polygonal shape of the aperture 25 and corresponding shape of the link 15 the housing is non-rotatably mounted upon the strand and the gem at all times faces outwardly as shown in FIG. 1.

Figure 3:
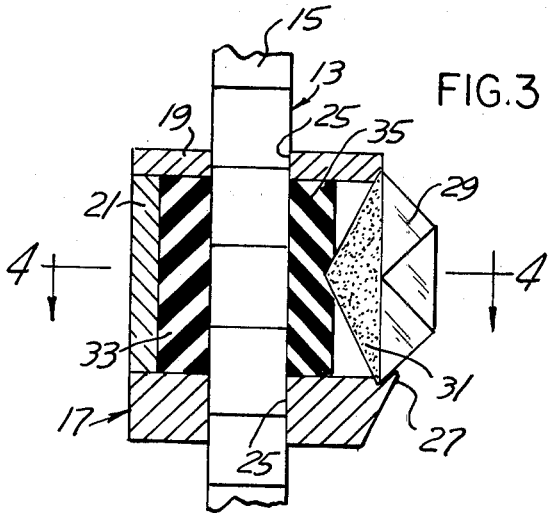
FIG. 3 is a vertical section taken in the direction of arrows 3—3 of FIG. 2.

As best shown in FIGS. 3 and 4 a second resilient spacer 35 in the form of a dust spacer is of a shape corresponding to the interior shape of the housing and is snugly and compressively positioned therein between the undersurface 31 of the ornamental gem or stone and the corresponding opposite side of the strand link 15.

This spacer also may be formed of silicone rubber, ordinary rubber, neoprene, cork or any other suitable resilient material which functions as a spacer so as to sealingly engage the undersurface of the stone 29 to prevent any accumulation of dirt or dust thereunder.

In the illustrative embodiment, the spacer 35 is preferably white in color so as not to absorb light.

In the illustrative embodiment upon the strand there are at least one pair of laterally opposed gem housing 19 which are secured together by a connector 37. This is for the purpose of holding together in parallel spaced relation the lower free end portions of the strand whose ends terminate in the stops or enlargements 39.

In use of the present necklace the respective gem supporting housings may be longitudinally adjusted as desired upon the strand portions such as shown in the drawing or in any other desired spacing including the opposed parallel spacing arrangement shown although not limited thereto.

Figure 5:
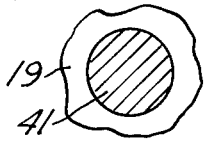
FIG. 5 is a fragmentary plan section of a strand of circular cross section.
Figure 6:
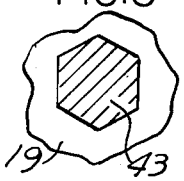
FIG. 6 is a similar view of one form of strand polygonal in cross section.
Figure 7:
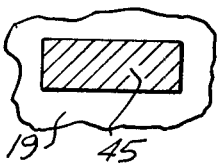
FIG. 7 is a similar view of a strand which is rectangular in cross section.

FIGS. 5, 6 and 7 fragmentarily illustrate different cross sectional shapes for the links such as round at 41, FIG. 5, six sided or polygonal at 43, FIG. 6, and rectangular at 45, FIG. 7.

The advantage of the polygonal shape for the links is that there is an automatic means for retaining the individual gem holding housings 19 against rotation relative to the strand so that at all times they face outwardly with the stone or gem facing outwardly as is intended.

In the case of a link which is round in cross section as at 41, FIG. 5, it is possible that by arranging the extent of friction and compression of the spacers 33 and 35 with respect to the link and strand, even such housing could be frictionally retained against accidental rotation in a direction other than directly outward.

While the ornamental device has been generally designated as a stone or gem, it is contemplated that in use any suitable stone or gem or ornament could be employed.

In the preferred embodiment of the invention the necklace has been described as including an elongated strand consisting of a series of links interconnected end to end and being of a polygonal cross section or round. It is contemplated that the strand instead could be merely a unit strand of a flexible metallic character not incorporating the links and wherein the applied housings mounting a gem are nevertheless adjustably and non-rotatably mounted upon the strand.

It is contemplated further that the present invention may be directed to other forms of jewelry as for example a bracelet consisting of a strand which may be a series of flexibly connected links or could be a unit strand upon which a series of ornamental slide housings are adjustably and non-rotatably mounted. In the case of a bracelet the free ends could be flexibly interconnected or could slightly overlap or be loosely interconnected. In any event in the case of a bracelet gem mounting housings would be slidably and selectively and adjustably mounted upon the strand with the gems facing outwardly to provide a very attractive piece of jewelry.

Having described my invention reference should now be had to the following claims.

I claim:

1. A necklace comprising an elongated flexible strand;

the depending free ends of the strand being substantially parallel and spaced apart;

a series of spaced slide housings mounted upon the strand for selective longitudinal adjustment thereon;

opposed walls of each slide housing having an aperture therethrough of a size and shape to cooperatively engage and receive the strand, the slide housings being non-rotatably mounted on the strand, each slide housing having an end wall and an outwardly facing ornamental end;

a resilient friction means within each said slide housing interposed in compression between the end wall and the strand for adjustably retaining said slide housing against longitudinal movement relative to the strand;

stop means on the ends of said strand;

a pair of housings, one of said pair on each of said strand ends, said pair being laterally spaced apart;

and means fixedly interconnecting said pair of housings.

2. A necklace comprising an elongated strand consisting of a series of links interconnected end to end;

the depending free ends of the strand being parallel and spaced apart;

a series of spaced slide housings mounted upon the strand for selective longitudinal adjustment threon;

opposed walls of each slide housing having an aperture therethrough of a size and shape to cooperatively engage and receive the strand, the slide housings being non-rotatably mounted on the strand, each slide housing having an end wall and an open end, the latter facing outwardly at right angles to the strand;

outwardly facing ornamental means nested and retained with the slide housing open ends;

a resilient friction means within each said slide housing interposed in compression between the end wall and the strand for adjustably retaining said slide housing against longitudinal movement relative to the strand;

stop means on the ends of said strand;

a pair of housings, one of said pair on each of said strand ends, said pair being laterally spaced apart;

and means fixedly interconnecting said pair of housings.

3. In the necklace of claim 2, the links being rectangular in cross section.

4. In the necklace of claim 2, the housings being square in cross section.

5. In the necklace of claim 2, the housings being cylindrical.

6. In the necklace of claim 2, said ornamental means being of a material selected from the group consisting of a semi-precious gem, a precious gem, and a stone.

7. In the necklace of claim 2, said ornamental means being retained by means including a series of spaced prongs extending radially inward of the housing.

8. In the necklace of claim 2, said housings being arranged in laterally opposed pairs upon said strand.

9. In the necklace of claim 2, said friction means being a spacer of silicone rubber, rubber or cork, of a shape corresponding to and snugly nested within said housing.

10. In the necklace of claim 2, a second resilient spacer interposed in compression between said strand and the undersurface of the ornamental means and of a shape corresponding to and snugly nested within said housing for excluding dust and dirt from the undersurface of the ornamental means.

11. In the necklace of claim 2, said links being of polygonal cross section, the slide housing apertures being of a corresponding shape.

12. In the necklace of claim 2, said links being round in cross section, the slide housing apertures being of a corresponding shape.

13. A necklace comprising an elongated flexible strand;

the depending free ends of the strand being substantially parallel and spaced apart;

a series of spaced slide housings mounted upon the strand for selective longitudinal adjustment thereon;

opposed walls of each slide housing having an aperture therethrough of a size and shape to cooperatively engage and receive the strand, the slide housings being non-rotatably mounted on the strand, each slide housing having an end wall and an open end, the latter facing outwardly at right angles to the strand;

outwardly facing ornamental means nested and retained within the slide housing open ends;

a resilient friction means within each said slide housing interposed in compression between the end wall and the strand for adjustably retaining said slide housing against longitudinal movement relative to the strand;

stop means on the end of said strand;

a pair of housings, one of said pair on each of said strand ends, said pair being laterally spaced apart;

and means fixedly interconnecting said pair of housings.

* * * * *